US008950522B1

(12) United States Patent
Lenkman

(10) Patent No.: US 8,950,522 B1
(45) Date of Patent: Feb. 10, 2015

(54) DRIVE UNIT FOR PROPELLING A CART FORWARD-AND-BACKWARD AND SIDE-TO-SIDE

(71) Applicant: Thomas E. Lenkman, St. Charles, MO (US)

(72) Inventor: Thomas E. Lenkman, St. Charles, MO (US)

( * ) Notice: Subject to any disclaimer, the term of this patent is extended or adjusted under 35 U.S.C. 154(b) by 0 days.

(21) Appl. No.: 14/144,805

(22) Filed: Dec. 31, 2013

(51) Int. Cl.
*A61G 7/05* (2006.01)

(52) U.S. Cl.
CPC ..... *A61G 7/05* (2013.01)
USPC ..... 180/12; 180/23

(58) Field of Classification Search
USPC ..... 180/11, 12, 23
See application file for complete search history.

(56) References Cited

U.S. PATENT DOCUMENTS

| | | | | |
|---|---|---|---|---|
| 2,739,785 | A | 3/1956 | Gray | |
| 3,404,746 | A | 10/1968 | Slay | |
| 3,891,048 | A | 6/1975 | Burdick | |
| 4,221,273 | A | 9/1980 | Finden | |
| 5,083,625 | A | 1/1992 | Bleicher | |
| 5,535,843 | A | 7/1996 | Takeda et al. | |
| 6,382,336 | B1 | 5/2002 | Smith | |
| 6,390,213 | B1 * | 5/2002 | Bleicher | 180/65.1 |
| 7,134,515 | B2 | 11/2006 | Lenkman | |
| 7,191,854 | B2 | 3/2007 | Lenkman | |
| 7,311,161 | B2 | 12/2007 | Lee | |
| 7,419,019 | B1 | 9/2008 | White et al. | |
| 7,905,304 | B2 * | 3/2011 | Adachi | 180/12 |
| 8,397,846 | B2 | 3/2013 | Heimbrock et al. | |
| 2012/0198620 | A1 | 8/2012 | Hornbach et al. | |

* cited by examiner

*Primary Examiner* — Kevin Hurley
(74) *Attorney, Agent, or Firm* — Grace J. Fishel

(57) ABSTRACT

A drive unit for propelling a cart in a forward or reverse direction or from side-to-side. The drive unit has a top plate affixed to a bottom frame of the cart. A pivot plate carrying a drive wheel carriage is pivoted from the plate. The drive wheel carriage includes a yoke in which a drive wheel is mounted. The drive wheel carriage is rockably and rotatably suspended from the pivot plate with the drive wheel biased out of contact with a supporting surface by a spring and biased into contact with the supporting surface with an inflatable air bag. The drive wheel may propel the cart forward when the drive wheel is aligned with the cart's longitudinal axis and from side-to-side when the drive wheel is aligned with the cart's transverse axis.

10 Claims, 6 Drawing Sheets

DRIVE UNIT FOR PROPELLING A CART FORWARD-AND-BACKWARD AND SIDE-TO-SIDE

BACKGROUND OF THE INVENTION

1. Field of the Invention

The present invention relates to a drive unit primarily for use in the medical field for propelling a cart in a forward or reverse direction as well as from side-to-side.

2. Brief Description of the Prior Art

Patients are often moved from one location to another on hospital beds, gurneys, stretchers, patient chairs, lifts, etc. which may be generally described as "carts." Some carts such as hospital beds have a fairly long and narrow wheel base to accommodate the narrow corridors and elevators found in many hospitals. Corners and narrow doorways also add to the inherent difficulty found in moving patients, often in life threatening situations, through hospitals or other treatment facilities.

The underside of the medical carts is typically mounted on four swivel wheels. Each wheel may swivel independently 360° about a generally upright axis so that the cart may be steered. There are many drive units for propelling a cart in a forward or reverse direction but an effective drive unit that will allow an operator without manual intervention to move a cart side-to-side to "park" the cart against a wall, etc. has been lacking.

BRIEF SUMMARY OF THE INVENTION

In view of the above, it is an object of the present invention to provide a drive unit for a cart such as a hospital bed or gurney that allows the operator to easily move the cart from side-to-side as well as forward or reverse. Other objects and features of the invention will be in part apparent and in part pointed out hereinafter.

In accordance with the invention, a drive unit is disclosed for propelling a cart in a forward and reverse direction as well as from side-to-side. The drive unit includes a top plate adapted to be affixed to a lower frame of a cart. A pivot plate is mounted under the top plate on a pivot axis. The pivot plate carries a drive wheel carriage which is rockably and rotatably suspended under the pivot plate on a pin. The drive wheel carriage has a yoke in which a reversible motor and at least one drive wheel are mounted. The drive wheel is biased out of contact with a supporting surface by a spring and forced into contact with the supporting surface by an inflatable air bag. When the drive wheel is aligned with a longitudinal axis of the cart and the drive wheel is in contact with the support surface, the drive wheel may propel the cart either forward or reverse and when the drive wheel is aligned with a transverse axis the drive wheel may propel the cart either to the right or to the left.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
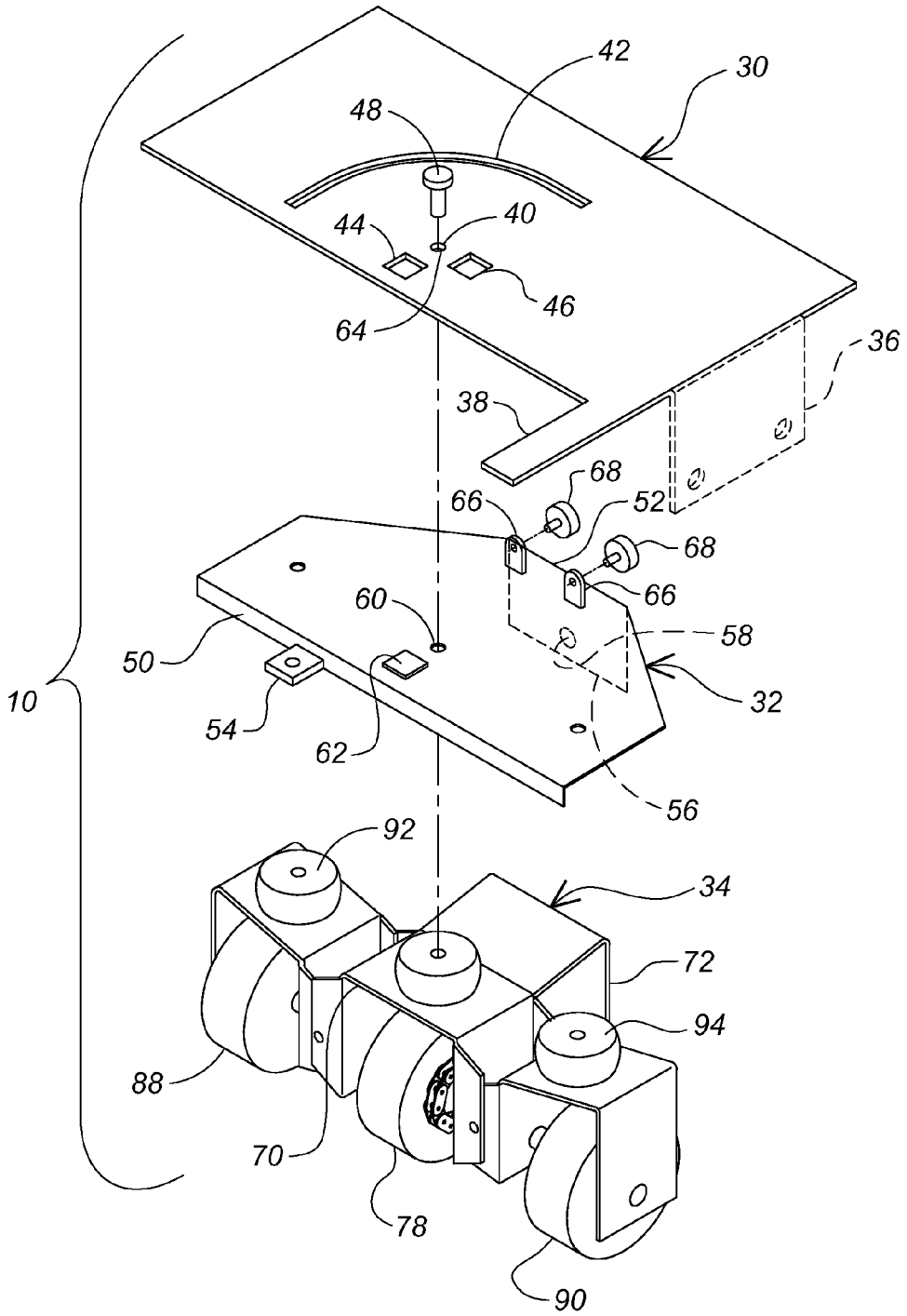
FIG. 1 is a perspective exploded view of a drive unit in accordance with the present invention including a fixed top plate, pivot plate and drive wheel carriage.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the drawings more particularly by reference numeral, reference character 10 refers to a drive unit in accordance with the present invention. Drive unit 10 is designed for use on a cart 12 which generically refers to a wheeled device bearing loads and includes devices for moving patients such as hospital beds, gurneys, stretchers, patient chairs, lifts and the like. An illustrative cart 12 in the form of a hospital bed is shown in FIG. 8.

Figure 8:
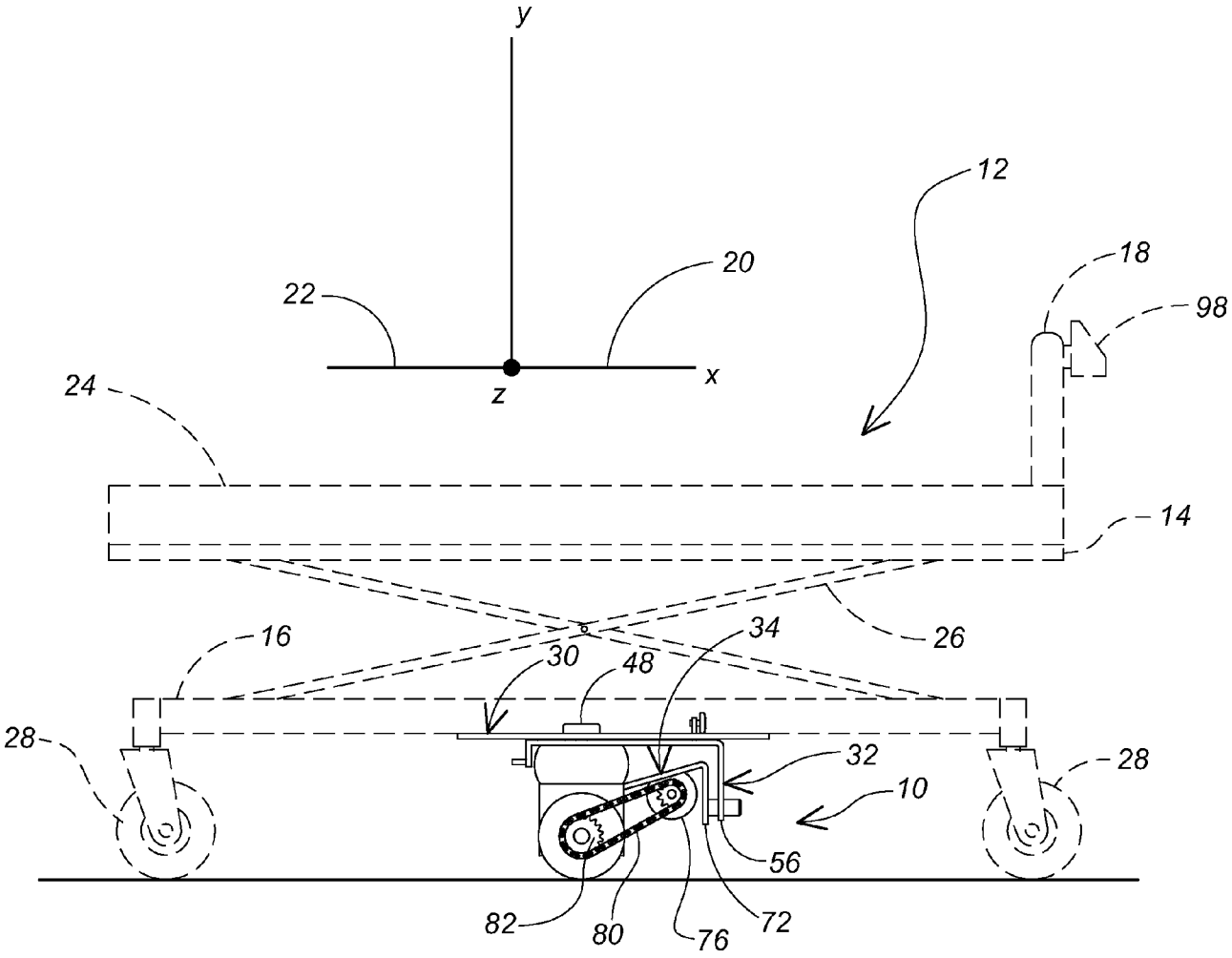

As shown in FIG. 8, cart 12 has a horizontal top frame 14 and a bottom frame 16. Top frame 14 has a push handle 18 along a rear edge to facilitate control of the cart in both the forward and reverse direction along a longitudinal axis 20 and the side-to-side direction along a transverse axis 22. Typically, cart 12 in the form of a hospital bed includes a mattress 24 on top frame 14 and a lifting and lowering device 26 for changing the elevation of top frame 14 to facilitate patient transfer. Four swivel wheels 28 are mounted at each of the four corners of bottom frame 16 for allowing rolling and turning movements of the cart. Each wheel 28 preferably swivels independently through a 360° arc about a generally vertical axis so that cart 12 may be steered in any direction by an operator. As shown, drive unit 10 is mounted generally in the central area of bottom frame 16 between swivel wheels 28.

Turning to FIG. 1, drive unit 10 in major part includes a top plate 30, a pivot plate 32 and a drive wheel carriage 34. Top plate 14 is fixed to bottom frame 16 of cart 12 with means suitable to the construction of the cart's bottom frame. For example, fixed top plate 30 may include one or more lateral support plates 36 extending vertically downwardly from a side edge to prevent fixed top plate 30 from shifting relative to the longitudinal or transverse axis 20, 22 of the particular cart. With the above in mind, while fixed top plate 30 is shown as a flat surface it can include a wide number of brackets, flanges, etc. to mount the plate to bottom frame 16 of the particular cart 12.

With continuing reference to FIG. 1, fixed top plate 30 includes an extension 38 which serves as a support base for mounting a linear actuator as more particularly described below. Fixed top plate 30 and extension 38 may be formed as a one-piece integral unit with extension 38 protruding from a side portion of fixed top plate 30. Fixed top plate 30 is further provided with a pivot hole 40, an arc cutout 42 and first and second detent apertures 44, 46.

Figure 3:
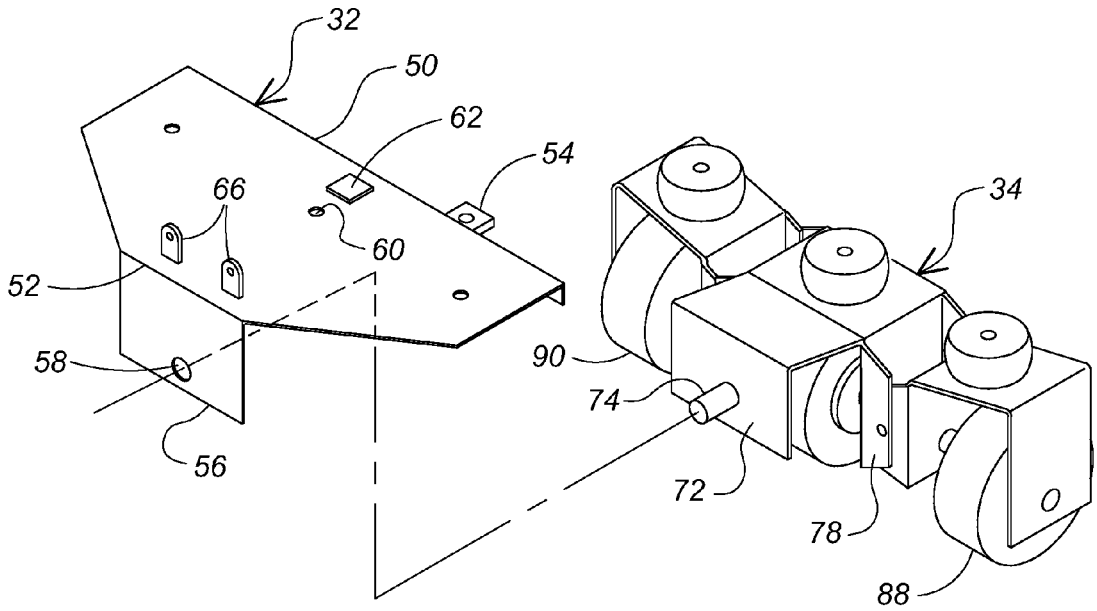
FIG. 3 is a perspective view of the pivot plate carrying the drive wheel carriage.
Figure 4:
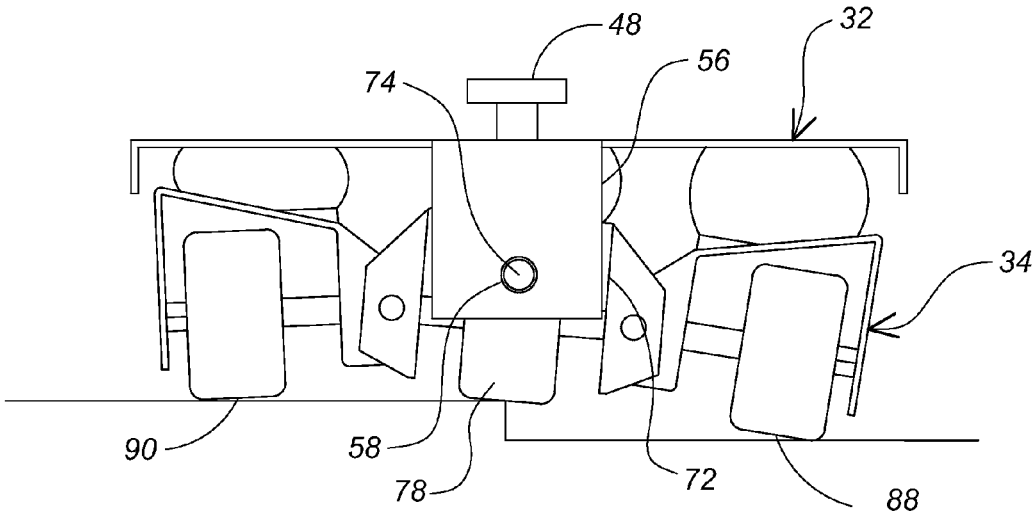
FIG. 4 is a rear view showing the drive wheel carriage rockably and rotatably suspended from the pivot plate.
Figure 5A:
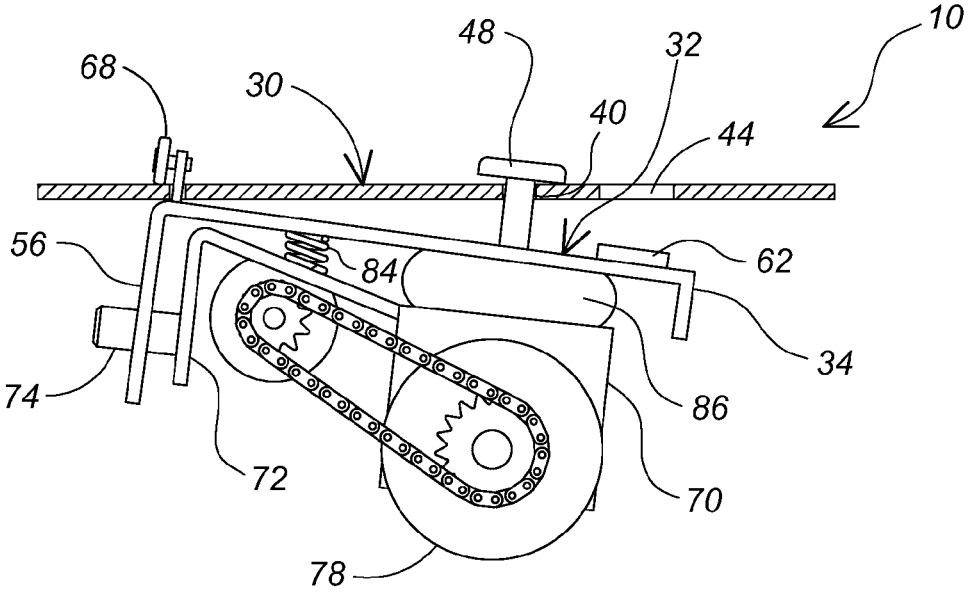
FIG. 5A shows the drive wheel carriage hanging canted from the pivot plate with the air bag above the drive wheel deflated and a detent on the pivot plate disengaged from a recess in the fixed top plate.
Figure 5B:
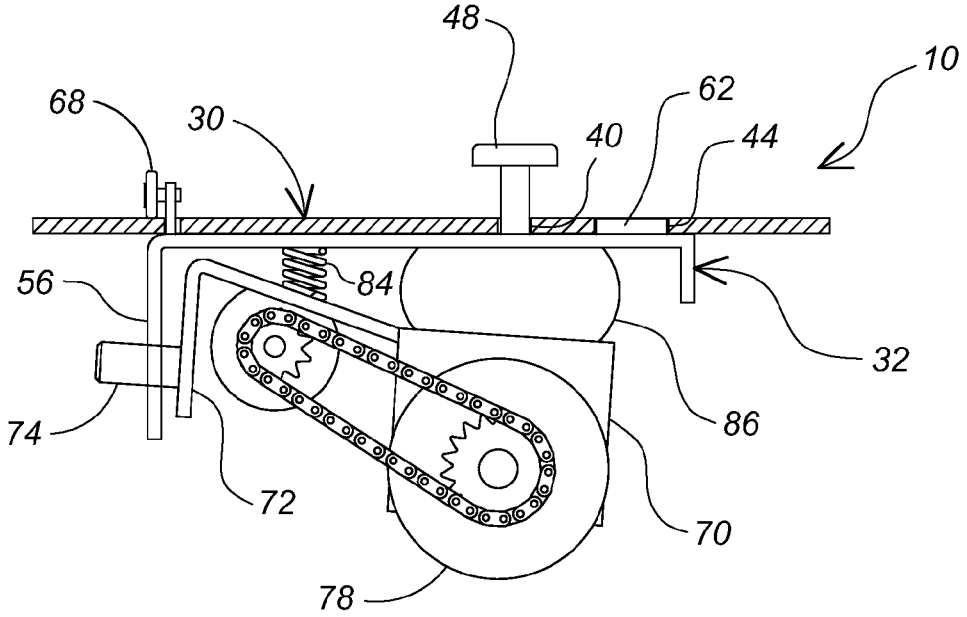
FIG. 5B shows the air bag inflated with the drive wheel forced into contact with the support surface and the detent on the pivot plate received in the recess in the fixed top plate.

Pivot plate 32 is suspended from fixed top plate 30 by a pivot axis 48. In the form illustrated, pivot plate 32 is an irregular hexagon with a first longer side edge 50 and a shorter, parallel second side edge 52. A flange with a tab 54 for mounting a linear actuator is provided along first side edge 50 and a lateral support flange 56 with a horizontal hole 58 (FIGS. 1 and 4) extends vertically downwardly from shorter, second side edge 52. A vertical hole 60 is provided in pivot plate 32 in alignment with pivot hole 40 in fixed top plate 30 for pivot axis 48 together with a detent 62 for engagement with first or second detent apertures 44, 46 in fixed top plate 30. In assembly, pivot plate 32 is biased, as shown in FIG. 5A, such that it hangs canted on pivot axis 48 with detent 62 disengaged. A pivot bearing (not shown) may be provided in fixed top plate 30 to facilitate this movement. Pivot plate 30 has one or more upstanding tabs 66 (FIGS. 1 and 3) centered on hole 60 in registry with cutout 42 in fixed top plate 30. Each of tabs 66 has a roller 68 adapted to roll on the surface of fixed top plate 30 adjacent cutout 42 while tabs 66 serve as guides for pivoted movement of pivot plate 32 on pivot axis 48 through at least a 90° angle (FIGS. 6-7).

Figure 2A:
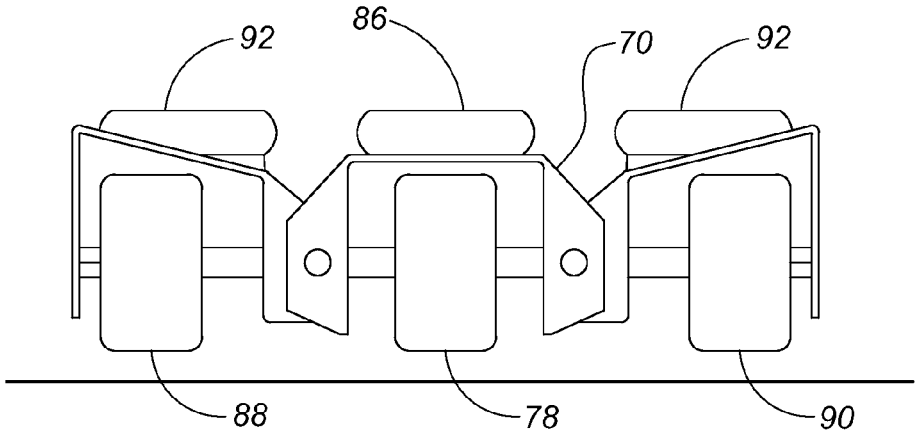
FIG. 2A is a front elevation of a drive wheel carriage with a center drive wheel flanked by wheels shown with air bag deflated such that the wheels are out of contact with a support surface.
Figure 2B:
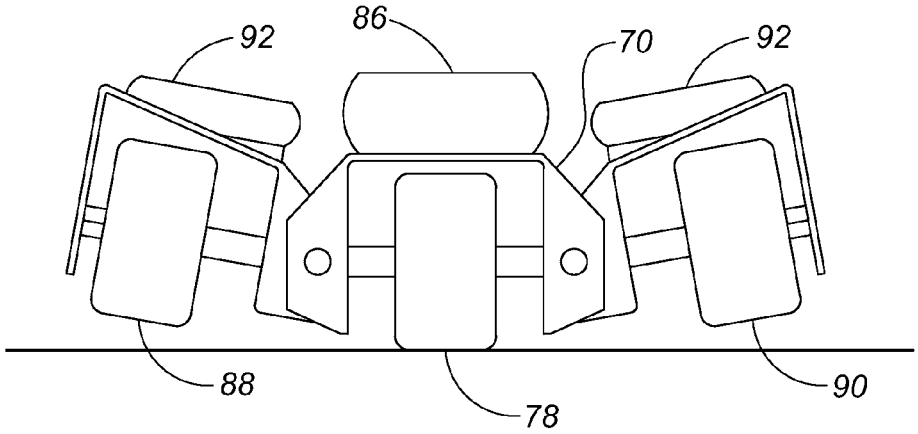
FIG. 2B shows the air bag above the center drive wheel inflated such that the drive wheel is in contact with the support surface.
Figure 2C:
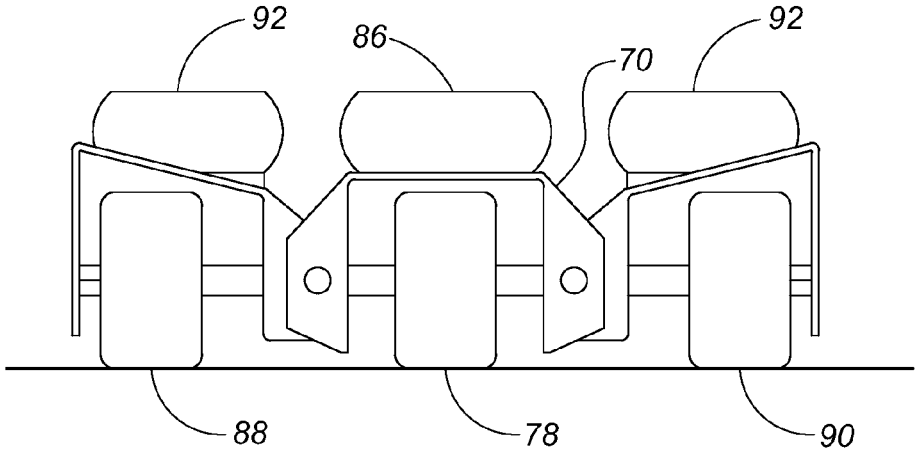
FIG. 2C shows the air bags above the center drive wheel and the flanking wheels inflated such that all of the wheels are in contact with the support surface.

Drive wheel carriage 34 is carried for rotation with pivot plate 32 and includes a yoke 70 mounted on an arm 72. Arm 72 has a downwardly extending mounting flange with an outwardly extending pin 74 passing though hole 58 for rockably and pivotally suspending yoke 70 on pin 74 as best seen in FIG. 4. A reversible motor 76 and at least one drive wheel 78 are mounted in yoke 70. An output shaft of motor 76 is connected by a belt 80 to a pulley 82 for rotating drive wheel 78 in a clockwise or counter-clockwise direction. As shown in FIG. 5A, drive wheel 78 is suspended in yoke 70 with a spring force such that drive wheel 78 is out of contact with a supporting surface. In the form illustrated, spring 84 is a torsion spring between arm 72 and pivot plate 32 but a compression spring, leaf spring or the like may be used with other arrangements. An air bag 86 is sandwiched between yoke 70 and the underside of pivot plate 32 for forcing the drive wheel into contact with the supporting surface against the resisting force of the spring. Second and third drive wheels 88, 90 may be pivoted to first drive wheel 78 as seen in FIGS. 2A through 2C. They like first drive wheel 78 are mounted for rotation with pivot plate 32 and are resiliently biased by springs out of contact with the support surface but may be forced into contact with the supporting surface by air bags 92, 94. When air bag 86 and air bags 92, 94 are deflated, drive wheels 78 and 88, 90 are out of contact with the supporting surface as shown in FIG. 2A. When air bag 86 is inflated, center drive wheel 78 makes contact with the supporting surface as shown in FIG. 2B and when flanking air bags 92, 94 are inflated, second and third drive wheels 88, 90 rotate with first drive wheel 78.

For the purpose of rotating pivot plate 32 carrying drive wheel carriage 34, a linear actuator 96 is provided. While linear actuator 96 may be a hydraulic cylinder, gear train, electric actuator or the like, an air cylinder is preferred. On end of air cylinder 96 is attached to extension 38 on fixed top plate 30 and the other end to tab 54 on pivot plate 32. Air cylinder 96, like reversible motor 76 and a compressor for air bags 86 and 92, 94, is under operator control through switches 98 on handle 18, details of which are not shown for an understanding of the present invention by those having skill in the art. For similar reasons, the electrical circuitry, processing logic including defaults and battery compartment details to operate reversible motor 76, cylinder 96 and the compressor for air bags 86 and 92/94 are not shown. It will also be understood that some of the elements may be reversed, for example detent apertures 44, 46 may be positioned on pivot plate 32 and detent 62 may be located in fixed top plate 30. It will also be apparent that other stops may be used on pivot plate 32 and fixed top plate 30 to secure drive wheel 78 along either of the cart's longitudinal or transverse axis and to prevent an unintentional rotation of pivot plate 32 from the intended alignment.

Figure 6:
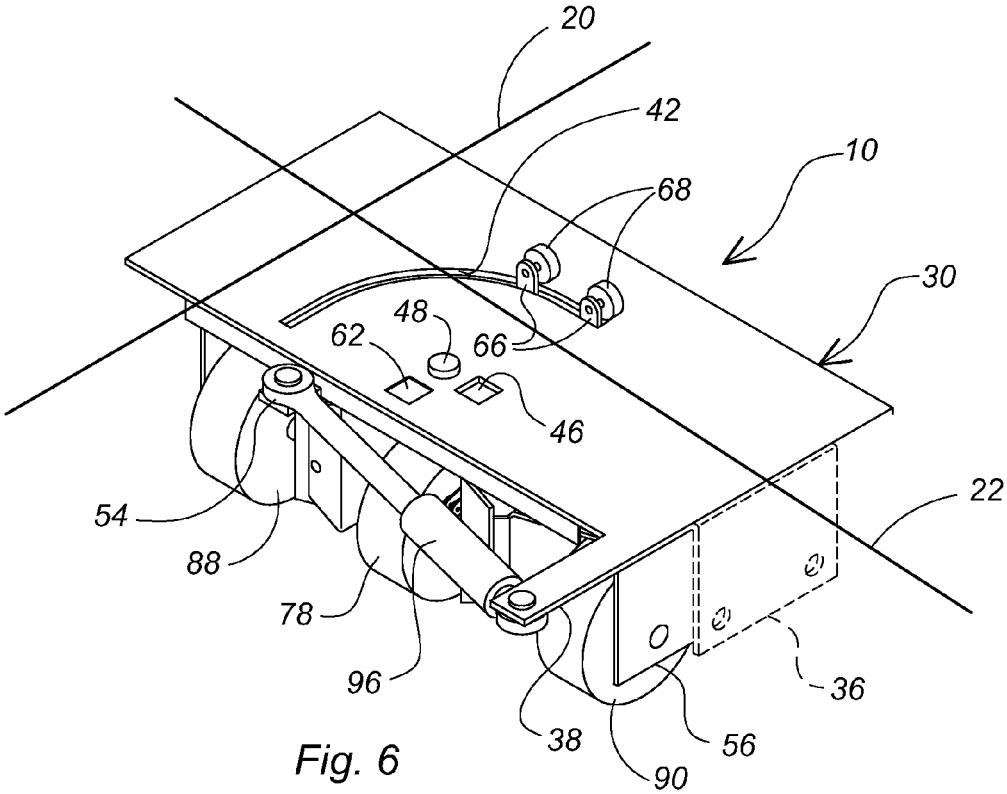
FIG. 6 is an assembled perspective view of the drive unit showing the drive wheel aligned with a longitudinal axis for propelling a cart forward and rearward.
Figure 7:
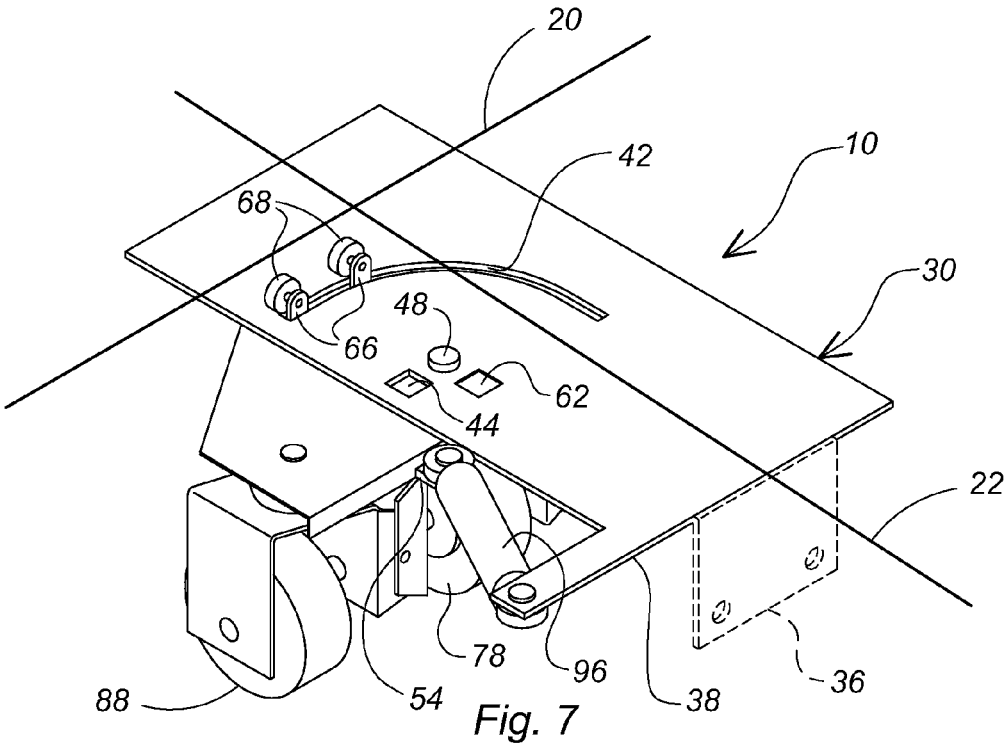
FIG. 7 shows the drive wheel aligned with a transverse axis for propelling a cart from side to side; and, FIG. 8 is a side elevation showing the drive unit mounted on a bottom frame of a cart such as a hospital bed.

In use, assuming that longitudinal axis 20 of cart 12 is perpendicular to the transverse axis of pivot plate 32 as shown in FIG. 6, reversible motor 76 may move cart 12 in a forward or rearward direction under control of the operator with detent 62 in recess 44 and drive wheel 78 engaged with the support surface. For best steerability with handle 18, it is preferred that second and third drive wheels 88, 90 not be in contact with the support surface. When side-to-side movement is wanted, air bag 88 above drive wheel 78 is deflated such that detent 62 is released from recess 44 and cylinder 96 may be used to rotate pivot plate 32 ninety degrees to the position shown in FIG. 7. Air bag 86 may then be inflated causing detent 62 to seat in recess 46. Reversible motor 76 may then be powered to propel cart 12 either sideways to the left or sideways to the right. During this movement it is preferred that second and third drive wheels 88, 90 be in contact with the supporting surface with air bags 92, 94 inflated. This provides extra traction and improves the ability of cart 12 to track sideways. With drive wheels 88, 90 down, an operator may park cart 12 easily even if the cart, such as a hospital bed, is loaded more to one end than the other.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

What is claimed:

1. A drive unit for a cart having a lower frame mounted on swivel wheels and a longitudinal axis and a transverse axis, said drive unit having a fixed top plate for attachment to the lower frame of the cart, said fixed top plate having a first pivot hole for a pivot pin;

a pivot plate having a second pivot hole for the pivot pin and suspended from the fixed top plate by the pivot pin, said pivot plate further having a downwardly extending attachment plate with a hole;

a drive wheel carriage having a yoke carried by the pivot plate and in which a reversible motor and at least one drive wheel are mounted, said yoke mounted on an arm with a downwardly extending flange with an outwardly extending pin, said pin passing through the hole in the attachment plate for rockably and rotatably suspending the yoke on the pivot plate by the pin, said yoke resiliently biased against the pivot plate by a spring such that the at least one drive wheel is out of contact with the supporting surface and selectively biased by an inflatable air bag for forcing the drive wheel into contact with the supporting surface against the resisting force of the spring, whereby the drive unit may propel a cart forward and reverse when the at least one drive wheel is aligned with the cart's longitudinal axis and forced into contact with supporting surface by the air bag and from side-to-side when the at least one drive wheel is aligned with the cart's transverse axis and forced into contact with the supporting surface.

2. The drive unit of claim 1 further comprising a linear actuator for rotating the pivot plate on the pivot pin, a first end of the linear actuator mounted to the fixed top plate and a second end of the linear actuator mounted to the pivot plate, said linear actuator rotating the pivot plate through at least a 90° angle to align the at least one drive wheel along either of the cart's longitudinal and transverse axes.

3. The drive unit of claim 2 wherein a stop is provided in the top fixed plate and the pivot plate to secure the drive wheel alignment with cart's longitudinal or transverse axis when the drive wheel is forced into contact with the supporting surface.

4. The drive unit of claim 3 wherein the stop comprises first and second apertures and a detent, said detent centered on the second pivot hole in the pivot plate and the first and second apertures centered about the first pivot hole in the fixed top plate, said first aperture receiving the detent when the pivot plate is rotated such that the at least one drive wheel is aligned with the cart's longitudinal axis and said second aperture receiving the detent when the pivot plate is rotated such that the at least one drive wheel is aligned with the cart's transverse axis.

5. A drive unit for a cart having a lower frame mounted on swivel wheels and a longitudinal axis and a transverse axis, said drive unit having a fixed top plate for attachment to the lower frame of the cart, said fixed top plate having a first pivot hole for a pivot pin;

a pivot plate having a second pivot hole for the pivot pin and suspended from the fixed top plate by the pivot pin, said pivot plate further having a downwardly extending attachment plate with a hole;

a drive wheel carriage having a yoke carried by the pivot plate and in which a reversible motor and a first drive wheel is mounted with second and third drive wheels pivoted to the first drive wheel, said first drive wheel connected to the reversible motor, said yoke mounted on an arm with a downwardly extending flange with an outwardly extending pin, said pin passing through the hole in the attachment plate for rockably and rotatably suspending the yoke on the pivot plate by the pin, said yoke resiliently biased against the pivot plate by a spring such that the first drive wheel is out of contact with the supporting surface and selectively biased by an inflatable air bag for forcing the drive wheel into contact with the supporting surface against the resisting force of the spring, each of said second and third drive wheels resiliently biased against the pivot plate by second and third springs, respectively, such that said second and third drive wheels are out of contact with the supporting surface and each of said second and third drive wheels selectively biased by second and third air bags, respectively, for forcing said second and third drive wheels into contact with the supporting surface against the resisting force of the second and third springs, said first air bag inflated independently of the second and third air bags, a linear actuator for rotating the pivot plate on the pivot pin, a first end of the linear actuator mounted to the fixed top plate and a second end of the linear actuator mounted to the pivot plate, said linear actuator rotating the pivot plate through at least a 90° angle to align the at least one drive wheel along either of the cart's longitudinal and transverse axes, whereby the drive unit may propel a cart forward and reverse when the first drive wheel is aligned with the cart's longitudinal axis and forced into contact with supporting surface by the first air bag and from side-to-side when the first drive wheel is aligned with the cart's transverse axis and first, second and third drive wheels are forced into contact with the supporting surface by the first, second and third air bags.

6. The drive unit of claim 5 wherein the first hole to accommodates the rocking movement pivot plate.

7. The drive unit of claim 5 wherein a stop is provided in the top fixed plate centered on the first pivot hole and in the pivot plate centered on the second pivot hole to secure the first drive wheel's alignment with the cart's longitudinal or transverse axis when the first drive wheel is forced into contact with the supporting surface.

8. The drive unit of claim 7 wherein the pivot plate is biased such that it hangs canted on the pivot pin in the first pivot hole with the stop disengaged when the first drive wheel is out of contact with the supporting surface.

9. The drive unit of claim 5 wherein the fixed top plate has an arc shaped cut-out centered on the first pivot hole, said pivot plate having at least one upstanding tab in registry with the cut-out;

each tab having a roller adapted to roll on the surface of the pivot plate adjacent the cut-out.

10. The drive unit of claim 1 wherein the yoke has a center yoke section with a first axle on which the first drive wheel is mounted, said first section is flanked by second and third yoke sections with second and third axles on which the second and third drive wheels are mounted, said second and third yoke sections pivoted to the first yoke section, each of said yoke sections having separate air bags and springs for biasing the yoke sections in and out of contact with the support surface.

* * * * *